US005267421A

United States Patent [19]

Salisbury

[11] Patent Number: 5,267,421

[45] Date of Patent: Dec. 7, 1993

[54] WINDOW GRID

[76] Inventor: Thomas L. Salisbury, 6040 W. Mead Rd., R.D. #1, St. Johns, Mich. 48879

[21] Appl. No.: 981,087

[22] Filed: Nov. 24, 1992

[51] Int. Cl.[5] ..... E04C 1/00

[52] U.S. Cl. ..... 52/314; 52/456; 52/665; 52/668

[58] Field of Search ..... 52/314, 656.8, 664–668, 52/456

[56] References Cited

U.S. PATENT DOCUMENTS

| | | | |
|---|---|---|---|
| 3,946,531 | 3/1976 | Armstrong | 52/668 X |
| 4,060,950 | 12/1977 | Rackard | 52/668 X |
| 4,145,858 | 3/1979 | Dovman | 52/668 X |
| 4,586,306 | 5/1986 | Webb | 52/456 X |
| 4,723,388 | 2/1988 | Zieg | 52/656.8 X |
| 4,783,938 | 11/1988 | Palmer | 52/456 X |
| 4,907,389 | 3/1990 | Pettit | 52/668 |
| 5,048,252 | 9/1991 | Osborn | 52/456 |

*Primary Examiner*—Carl D. Friedman
*Assistant Examiner*—Beth A. Aubrey
*Attorney, Agent, or Firm*—Leon Gilden

[57] ABSTRACT

A window grid includes plural pairs of orthogonally intersecting plate members adhesively mounted onto a window pane for simulation of a grid structure, as well as providing for strengthening of the window in use.

2 Claims, 4 Drawing Sheets

WINDOW GRID

BACKGROUND OF THE INVENTION

1. Field of the Invention

The field of invention relates to window grid structure, and more particularly pertains to a new and improved window grid wherein the same is arranged for ease of mounting to an associated window pane.

2. Description of the Prior Art

Window grids of various types have been utilized in the prior art for enhanced appearance, as well as reinforced strengthening of window structure. A window grid arrangement in the prior art is indicated in U.S. Pat. No. 4,403,052 to Summers, et al. having a window grid structure utilizing individual bar members coated onto the window pane structure.

U.S. Pat. No. 5,048,252 to Osborn sets forth a window grid having locking structure for locking the window grid arrangement to the window frame.

U.S. Pat. Nos. 4,899,490 and 4,970,840 set forth window grid and grill structure mounted to a window opening.

Accordingly, it may be appreciated there continues to be a need for a new and improved window grid as set forth by the instant invention addressing both the problems of ease of use as well as effectiveness in construction in the mounting and securement to a window pane and in this respect, the present invention substantially fulfills this need.

SUMMARY OF THE INVENTION

In view of the foregoing disadvantages inherent in the known types of window grid structure now present in the prior art, the present invention provides a window grid wherein the same is arranged for adherably mounting to an associated window pane. As such, the general purpose of the present invention, which will be described subsequently in greater detail, is to provide a new and improved window grid which has all the advantages of the prior art window grid structure and none of the disadvantages.

To attain this, the present invention provides a window grid including plural pairs of orthogonally intersecting plate members adhesively mounted onto a window pane for simulation of a grid structure, as well as providing for strengthening of the window in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window grid which has all the advantages of the prior art window grid structure and none of the disadvantages.

It is another object of the present invention to provide a new and improved window grid which may be easily and efficiently manufactured and marketed.

It is a further object of the present invention to provide a new and improved window grid which is of a durable and reliable construction.

An even further object of the present invention is to provide a new and improved window grid which is susceptible of a low cost of manufacture with regard to both materials and labor, and which accordingly is then susceptible of low prices of sale to the consuming public, thereby making such window grids economically available to the buying public.

Still yet another object of the present invention is to provide a new and improved window grid which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
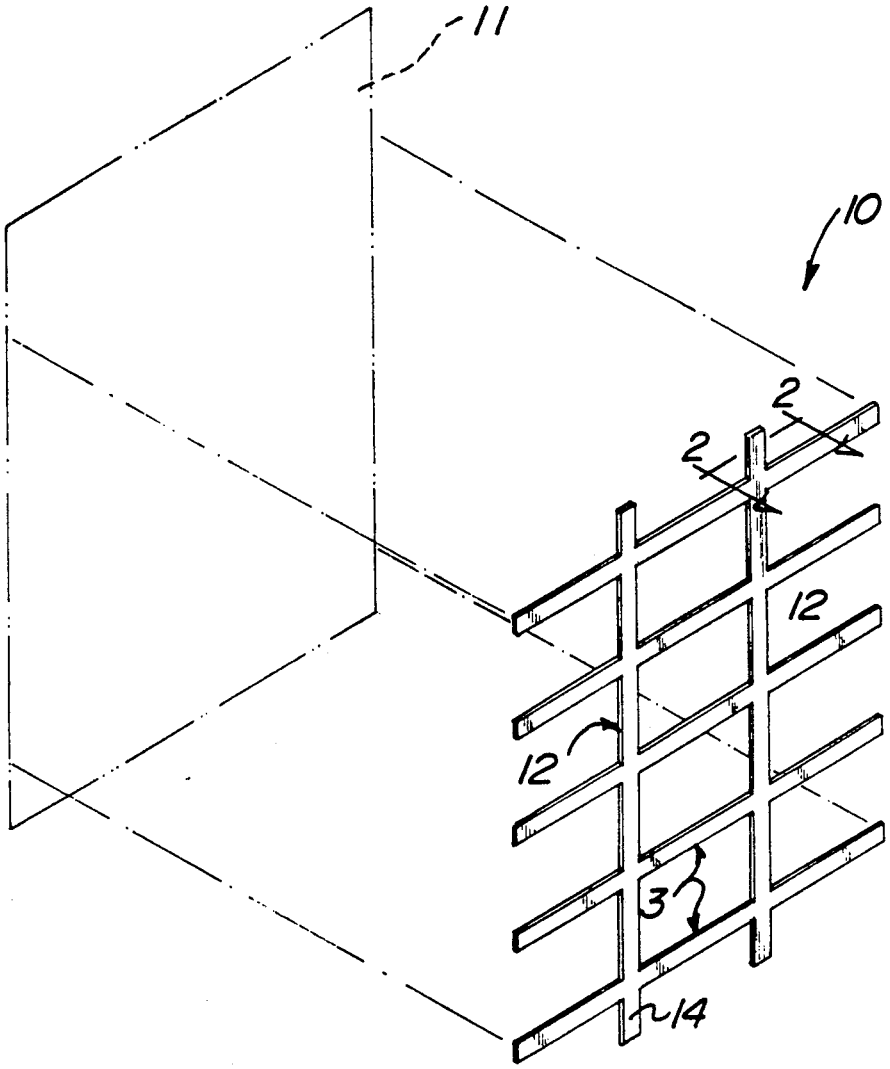
FIG. 1 is an isometric illustration of the invention.

With reference now to the drawings, and in particular to FIGS. 1 to 8 thereof, a new and improved window grid embodying the principles and concepts of the present invention and generally designated by the reference numerals 10, 10*a*, and 10*b* will be described.

Figure 2:
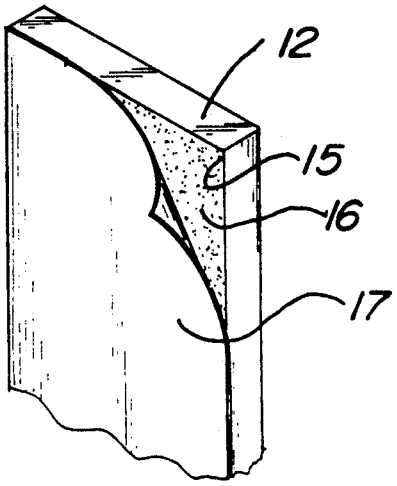
FIG. 2 is an isometric illustration of section 2—2 as indicated in FIG. 1.

More specifically, the window grid 10 of the instant invention essentially comprises mounting to a transparent window pane 11. The grid includes a plurality of parallel first plate members 12 orthogonally and integrally secured to a plurality of parallel second plate members 13. Each of the plate members includes a front wall 14 parallel relative to a rear wall 15, with an adhesive layer, as indicated in FIG. 2, arranged coextensive relative to the rear wall 15, and further including a flexible peel-away protective layer 17 surmounted relative to the adhesive layer 16 for ease of adhesive securement to the window pane 11.

Figure 3:
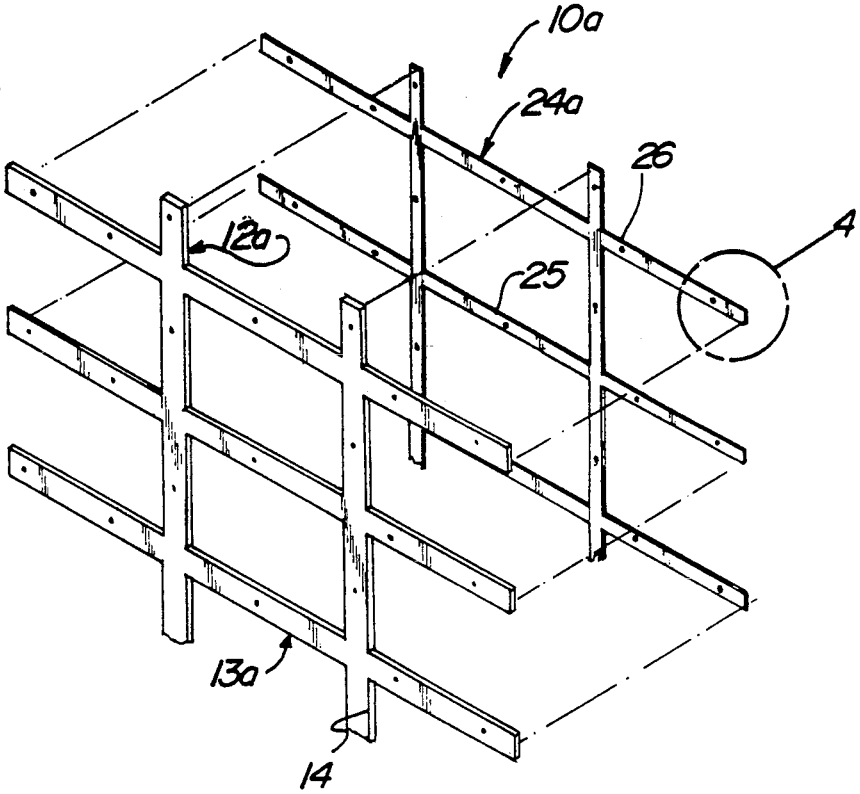
FIG. 3 is an isometric illustration of a modified aspect of the invention.
Figure 4:
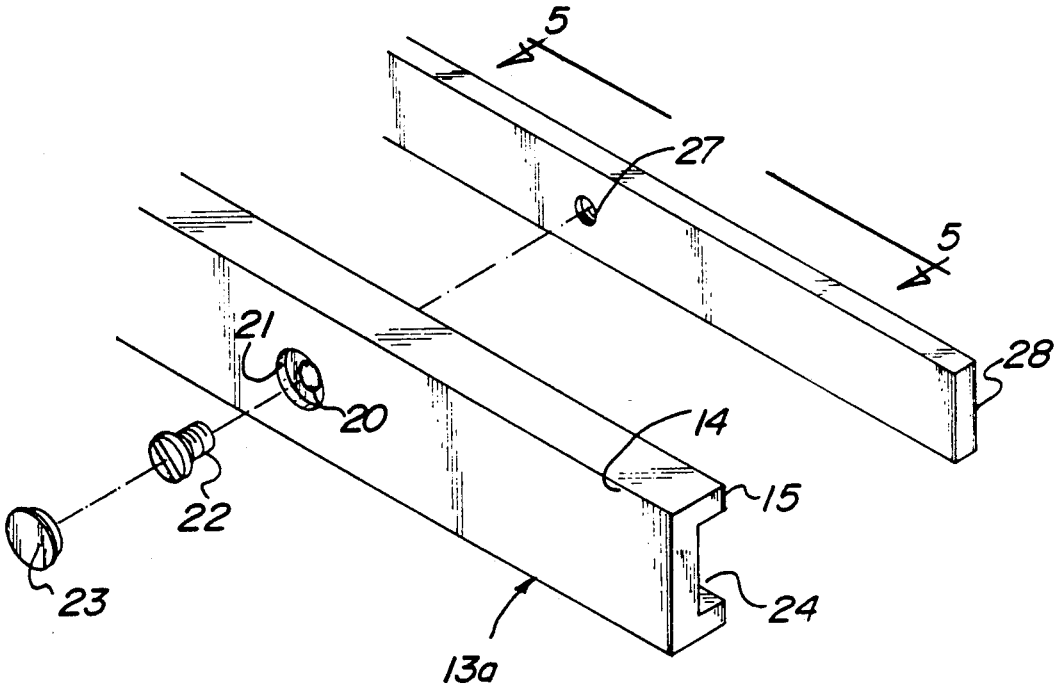
FIG. 4 is an isometric exploded view to include section 4 as set forth in FIG. 3.

The window grid structure 10*a*, as indicated in FIGS. 3 and 4, includes modified first and second plate members 12*a* and 13*a* arranged in a predetermined configuration, as indicated in FIG. 3, with a plurality of plate first bores 20 orthogonally directed through the plate members front and rear walls 14 and 15, with a countersunk plate second bore 21 directed into the front wall 14 coaxially aligned with and in surrounding relationship relative to the first bore 20, with the second bore 21 spaced from the rear wall 15. Each of the rear walls 15 includes cooperative and intersecting channels 24 of a predetermined depth to receive a mounting grid 24*a* of a predetermined thickness equal to the predetermined depth. The mounting grid 24*a* accordingly complementarily received within the channel structure 23 is formed of respective first and second flanges 25 and 26 orthogonally intersecting one another having flange threaded bores 27 directed therethrough, with each of the threaded bores 27 coaxially aligned with one of the plate first bores 20 to receive the threaded fastener 22 through the plate first bore 20 into the flange threaded bore 27, with an associated channel plug 23 arranged for reception within the second bore 21 for masking the orientation of the fasteners 22. In this manner, the grid structure is arranged in a similar configuration, with the first and second flanges 25 and 26 having rupturable capsules 37 typically formed of a gelatinous material, having a fluid adhesive 38 contained therewithin (see FIG. 5). In this manner, the assembled grid structure 10*a* is mounted onto the associated window pane structure 11.

Figure 5:
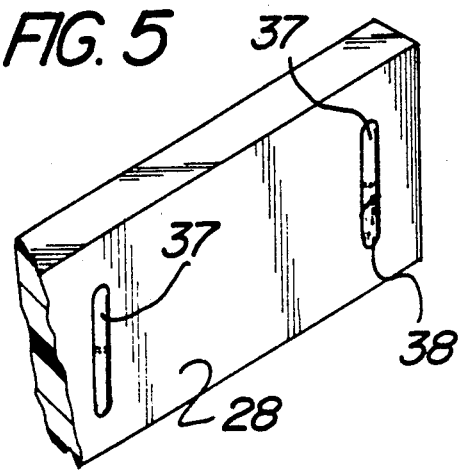
FIG. 5 is an isometric rear view, taken along the lines 5—5 of FIG. 4 in the direction indicated by the arrows.
Figure 6:
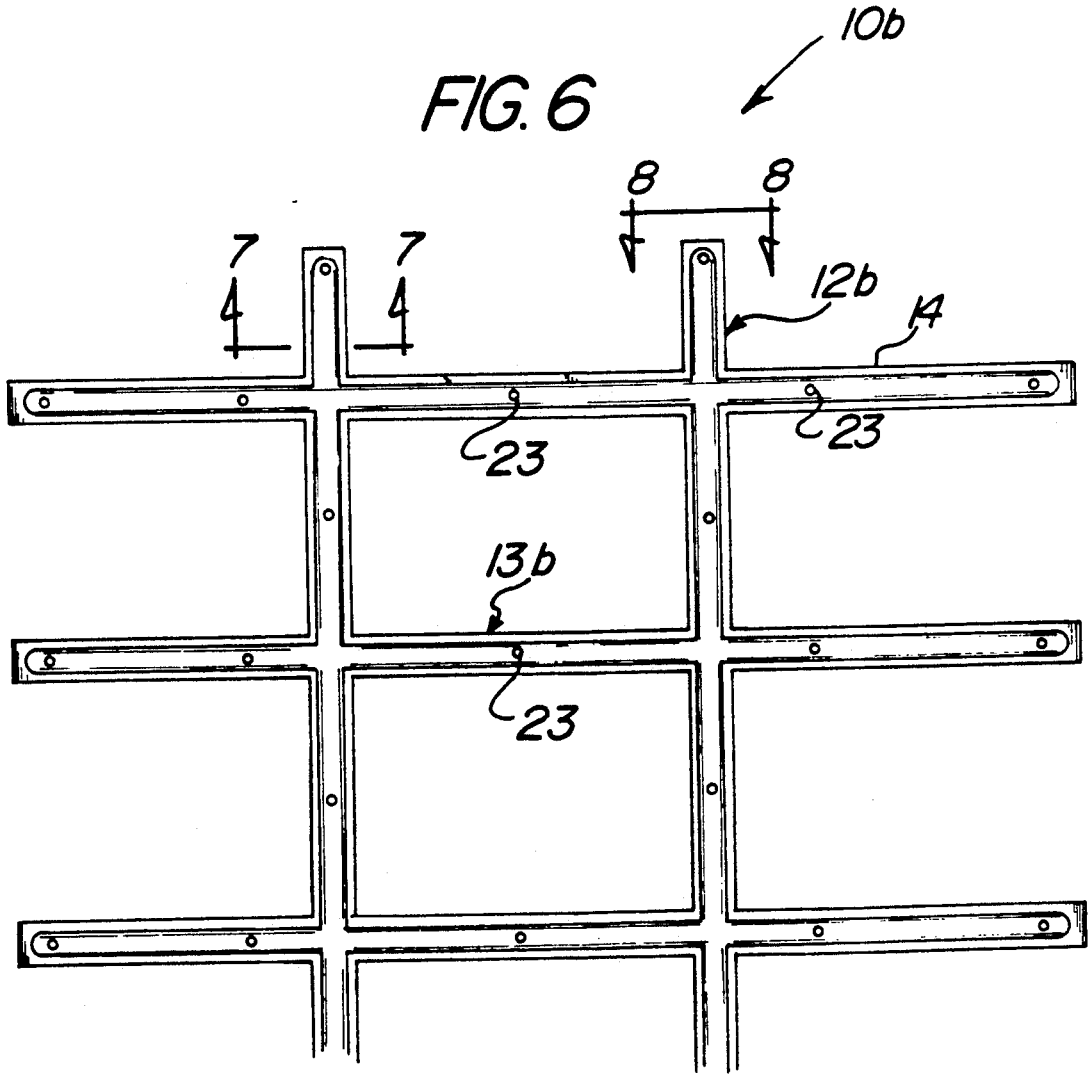
FIG. 6 is an orthographic frontal view of a further modified aspect of the invention.
Figure 7:
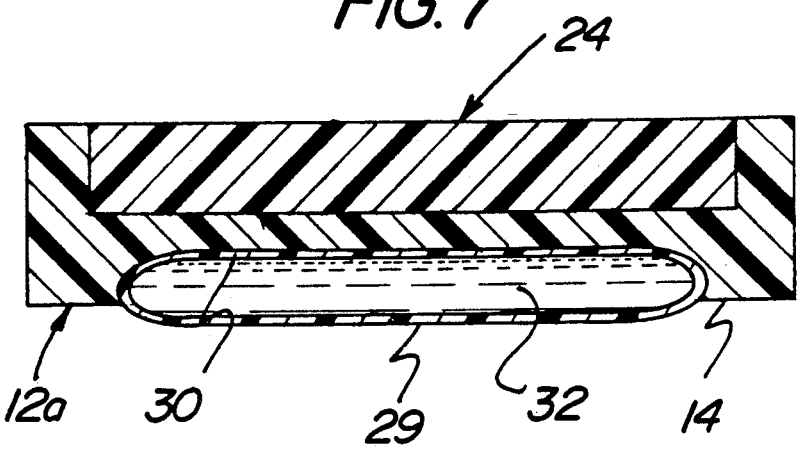
FIG. 7 is an orthographic view, taken along the lines 7—7 of FIG. 6 in the direction indicated by the arrows.
Figure 8:
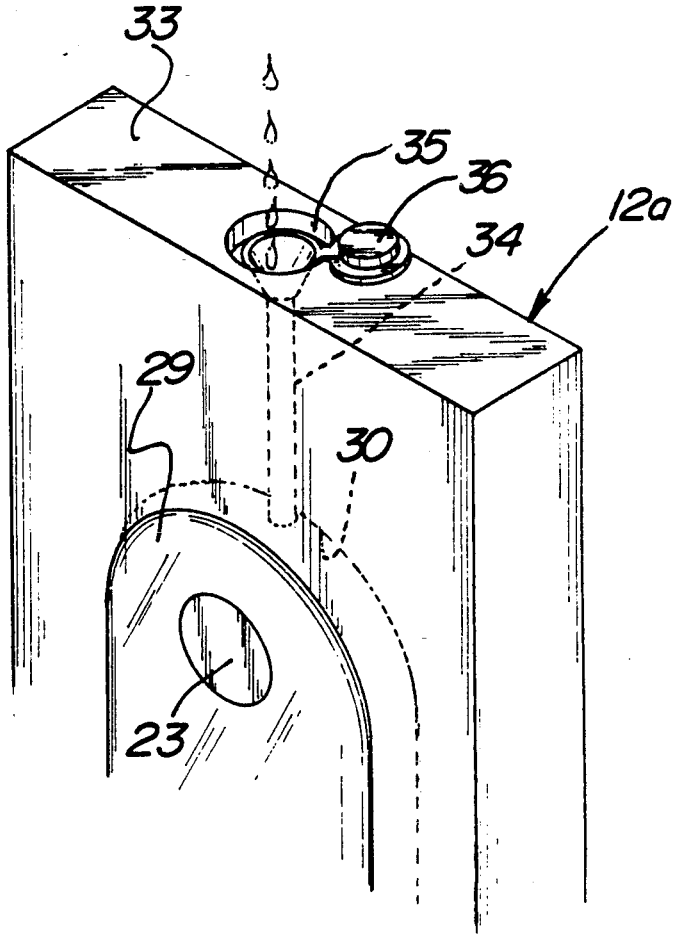
FIG. 8 is an isometric illustration, taken along the lines 8—8 of FIG. 6 in the direction indicated by the arrows.

The FIGS. 6–8 indicate a further modified window grid structure 10*b*, including the structure of the FIGS. 3–5, and further having a continuous transparent fluid reservoir 29 received within a continuous front wall recess 30 directed into the front wall 14 of the further modified first and second plate members 12*b* and 13*b*. The fluid reservoir 29 is of a rigid construction containing selectively various fluid colorations 32 coextensively therethroughout, with the reservoir 29 arranged in surrounding relationship relative to each of the aforenoted first and second bores 20 and 21. At least one of the further modified first plate members 12*b* includes a first plate member top wall 33 having a fluid conduit 34 in fluid communication with the top wall through an entrance port 35 and the fluid reservoir 29. A cap member 36 is arranged to seal the entrance port 35 upon filling of a desired coloration of fluid within the fluid reservoir structure 29. In this manner, decorative changes relative to seasons, dwelling coloration, and the like may be modified at an individual's inclination.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window grid arranged for mounting onto a window pane, comprising, a plurality of parallel first plate members orthogonally and integrally secured to a plurality of parallel second plate members, wherein the first plate members and second plate members each include a planar front wall and a planar rear wall, and adhesive mounting means secured to the rear wall for securing the first plate members and the second plate members to the window pane, and each rear wall includes an adhesive layer coextensive with each rear wall, and the adhesive layer includes a flexible peel-away protective layer removably mounted relative to the adhesive layer for exposing the adhesive layer to the window pane, and a plurality of first bores directed through the front wall and the rear wall, and a further mounting grid structure having a plurality of parallel first flanges orthogonally intersecting a plurality of second flanges, and each rear wall of the first plate members and the second plate members includes a channel, and the channel of the first plate members and the second plate members arranged to receive the first flanges and the second flanges therewithin, wherein the first flanges and the second flanges are of a predetermined thickness, and each said channel of said first plate member and said second plate member is of a predetermined depth equal to the predetermined thickness, wherein the adhesive mounting means includes a plurality of rupturable capsules mounted to the first flanges and the second flanges, wherein the first flange and the second flange each includes a flange rear wall, and the rupturable capsules are mounted to said rear wall, and each rupturable capsule includes a fluid adhesive contained therewithin.

2. A window grid as set forth in claim 1 wherein the first plate members and the second plate members include a continuous transparent fluid reservoir, and further include a continuous front wall recess, with the continuous transparent fluid reservoir received within the recess, and at least one of said first plate members includes a top wall, the top wall having an entrance port, and a fluid conduit in fluid communication between the entrance port and the fluid reservoir, and a fluid dye arranged for reception within the fluid reservoir through the fluid conduit, and a cap member arranged for sealingly engaging the entrance port.

* * * * *